United States Patent [19]

Wells

[11] 4,121,968

[45] Oct. 24, 1978

[54] SECONDARY VACUUM BOX FOR A ROTARY VACUUM FILTER

[75] Inventor: Roger Wells, Mercer Island, Wash.

[73] Assignee: Weyerhaeuser Company, Tacoma, Wash.

[21] Appl. No.: 757,793

[22] Filed: Jan. 3, 1977

[51] Int. Cl.[2] ..... D21F 1/48

[52] U.S. Cl. ..... 162/290; 162/297; 162/323; 162/364; 210/217; 210/402

[58] Field of Search ..... 162/290, 297, 307, 318, 162/321, 323, 335, 357, 364, 368; 210/217, 402, 216

[56] References Cited

U.S. PATENT DOCUMENTS

| | | | |
|---|---|---|---|
| 1,163,251 | 12/1915 | Millspaugh | 162/290 |
| 2,036,168 | 3/1936 | Engert et al. | 162/335 X |
| 2,714,839 | 8/1955 | Mazer | 162/297 |
| 2,843,025 | 7/1958 | Holden | 162/307 |
| 2,990,013 | 6/1961 | Rance et al. | 162/307 |
| 3,057,402 | 10/1962 | Webster | 162/318 X |

OTHER PUBLICATIONS

Simons et al., "Steam Dewatering of Filter Cakes", Chemical Engineering Progress, Vol. 62, No. 1, pp. 75-81, Jan. 1966.

*Primary Examiner*—Richard V. Fisher

[57] ABSTRACT

An apparatus for improving the dewatering capability of a rotary drum vacuum filter or washer is described in which a suction box, independently supported above the filter drum, having an apertured outermost surface, and a vacuum means operating upon the box, is combined with a foraminous belt, tensioned to contact the suction box apertured surface and that portion of the drum surface not adjacent the box such that rotation of the drum causes the belt to rotate with the drum, sliding over the suction box. In operation, a cake or fibrous web that is formed upon the belt while it is in contact with the filter drum surface, partially submerged in a slurry of the material to be recovered, is subsequently subjected to the suction box vacuum means as the belt-supported web passes over the apertured surface. A discharge box at the trailing edge of the suction box is supplied with pressurized air to blow the cake or fibrous web from the foraminous belt surface at the product discharge point. A steam hood for use in conjunction with the dewatering apparatus is described.

5 Claims, 4 Drawing Figures

Fig. 1
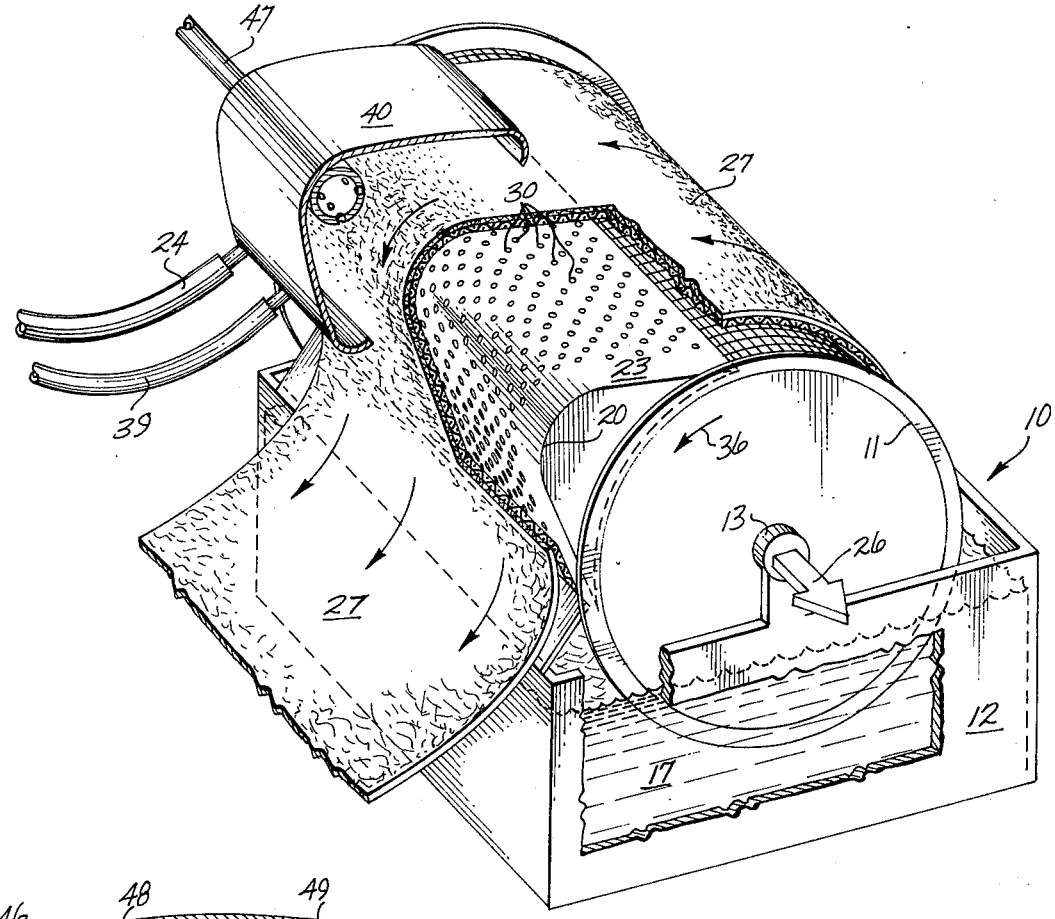
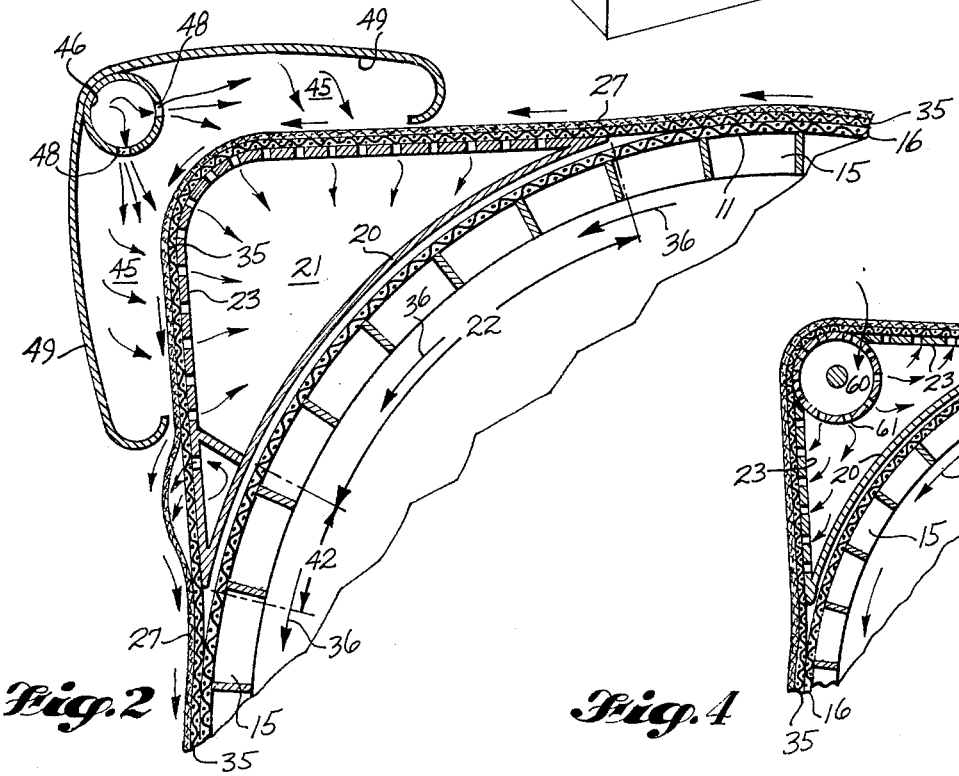
Fig. 2
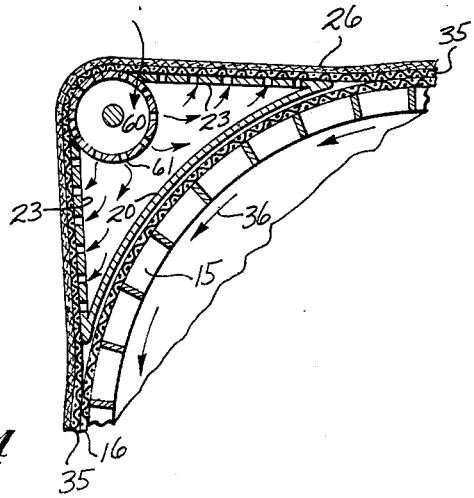
Fig. 4

SECONDARY VACUUM BOX FOR A ROTARY VACUUM FILTER

BACKGROUND OF THE INVENTION

This invention relates to apparatus for improving the dewatering capability of a rotary drum vacuum washer or filter. More particularly, dewatering capabilities are improved by the addition of a suction box attachment for increasing locally, with respect to a drum quadrant or section adjacent the suction box, the vacuum force acting upon a substantially insoluble material to be dewatered.

In the prior art, the removal of water from a slurry of a substantially insoluble material comprised of, for example, an inorganic mineral or a cellulosic fiber, using a rotary vacuum filter is well known. Generally, the apparatus comprises a rotary drum with closed ends and open internal structure which is covered with a felt, woven cloth or wire subjected to a vacuum force operating internally upon the drum. A portion of the lateral area of the drum is submerged in a dilute slurry of the material to be dewatered. The vacuum operating upon the filter drum causes a filter cake or web of the material to build up on the submerged portion of the wire or cloth exterior surface of the drum. As the submerged portion of the drum leaves the slurry, the cake is firmly held onto the surface and further water is removed by the action of the vacuum acting upon the exterior cloth of the drum. Wash water may be showered onto the cake or web as the periphery of the rotating drum advances to partially remove soluble contaminants or to displace contaminated solvent from the insoluble material. The vacuum is continuous around the periphery of the drum or at least up until the discharge point is reached, at which point a doctor blade removes the cake or web from the drum's cloth surface.

Many mill installations of rotary filters or washers avoid expensive vacuum pumps by utilizing barometric legs to provide vacuum for dewatering. These devices are somewhat limited in capacity, flexibility of operation and level of vacuum obtainable. As a result of these vacuum limitations and stock washing requirements, most cellulosic pulps, for example, discharge from the rotary stock washers or filters at 10–15% by weight bone dry solids. Generally, where the object of utilizing rotary filters is to wash out contaminants as well as water removal per se, several closely adjacent filters must be operated in line to get adequate displacement of impurities from the insoluble cake material.

Since floor space in most installations is at a premium, an apparatus for improving dewatering which could be attached to existing rotary vacuum drum equipment as installed in the typical dewatering, filtering or washing installation of today without requiring significant layout modifications would offer an attractive economic benefit at low capital cost. Where subsequent drying of the wet product is desired, improved dewatering would mean that less heat would have to be added to obtain a dry product. Where the insoluble material is to be washed free of soluble impurities, improved dewatering would mean that additional showering on existing equipment and better displacement of solution from the filter cake or web would be obtained.

In the past, localized improved dewatering of filter cakes or pulp webs supported upon traveling wires has been obtained by directing the wire over a suction box whereupon the material to be dewatered is subjected to a vacuum force operating upon the suction box. Mazer in U.S. Pat. No. 2,714,839 employes a stationary suction box, subtending an arcuate area of the interior surface of a rotary extractor drum or couch roll over which the wire-supported web passes. A steam hood supplies saturated steam to the wet paper web as it passes over the couch-suction box whereupon the suction box vacuum pulls a substantial amount of steam through the web. At least a portion of the steam condenses in the web, transferring heat to the fibers and its moisture content. Simons et al in an article entitled "Steam Dewatering of Filter Cakes" at 62 Chemical Engineering Progress 75 (January 1976) indicates that part of the dewatering advantage described in Mazer derives from the decrease in filtrate viscosity resulting from the increase in temperature.

SUMMARY OF THE INVENTION

The present invention, in combination with a rotary drum vacuum filter/washer, improves dewatering capability without major modification of design or layout of a standard filter/washer as typically installed. The improved combination comprises a suction box having an aperatured outermost surface adjacent an arcuate portion of the rotary drum, having supporting structure and vacuum means independent of the rotary drum filter, but located as close as possible to the periphery of the drum consistent with its free rotation. Additionally, a wire, felt, or cloth belt is wrapped around both drum and suction box so that the belt contacts the outermost apertured surface of the suction box while remaining in contact with that portion of the rotary drum not adjacent the suction box. The belt is tensioned sufficiently so that rotation of the rotary drum causes the belt to move along with it sliding over the suction box apertured surface.

Thus the dewatering capability of an existing rotary vacuum filter, after modification by the apparatus of this invention, is improved since the substantially insoluble cake or web in contact with the rotating belt may be subjected to a vacuum means independent of the relatively weak barometric leg means typically operating on the rotary drum.

The added dewatering capacity allows better washing of impurities from filter cakes or fibrous webs through increased solution displacement from the cake, utilizing an existing rotary vacuum filter, with only those modifications suggested by the invention.

The present invention may be modified by the addition of a steam hood positioned over the suction box supplying steam of substantially zero velocity to the cake or web, which steam is pulled into the cake as it passes over the suction box increasing the temperature of both solids and filtrate thereby further improving dewatering in accordance with the above-indicated Simons article.

The present invention may also be modified by the addition of a discharge box attached to the trailing edge of and equal in length to the suction box, sealed from the suction box vacuum means and provided with an air pressure means. The outermost surface of the chamber with respect to the drum surface is apertured and in contact with the moving belt means such that the action of the air through the belt upon the filter cake or web causes it to separate and release from the belt, for transfer to the next filter/washer or other process step. The belt may either slide across the apertured surface or be supported by a roller or bearing means.

BRIEF DESCRIPTION OF THE DRAWINGS

The following drawings show, by way of example, a preferred embodiment of the invention:

FIG. 1 is a perspective of the suction box improvement, in combination with a rotary drum vacuum filter and steam hood.

FIG. 2 is an end section view of the improved suction box showing its relationship to the filter drum and including a steam hood for supplying steam to a web.

FIG. 4 is an end view showing an embodiment for supporting the belt as it passes over the suction box.

DETAILED DESCRIPTION OF A PREFERRED EMBODIMENT

Figure 3:
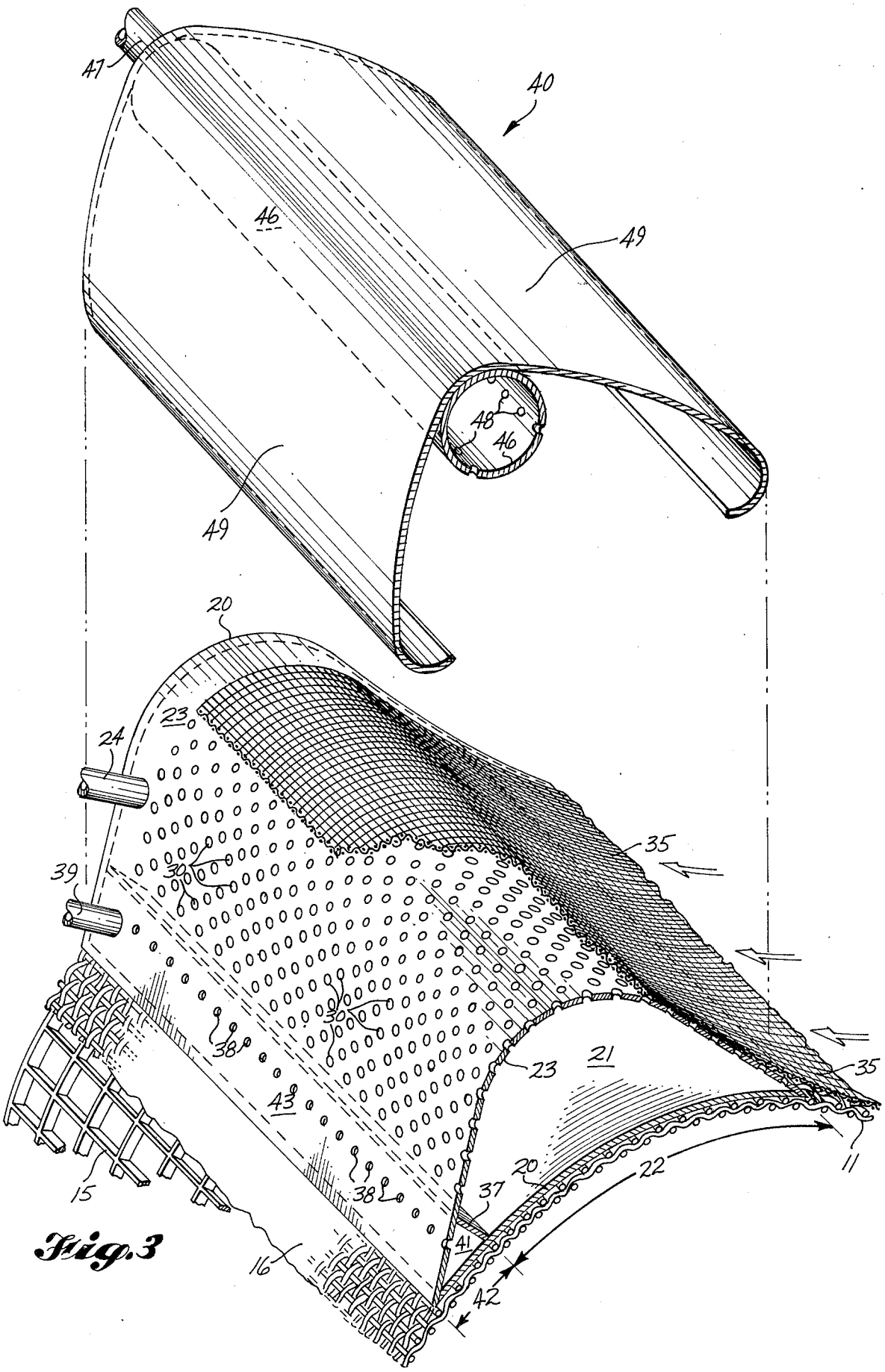
FIG. 3 is a perspective view showing suction box details including a cake discharge box scheme.

A preferred suction box apparatus for improving the dewatering capability of a rotary drum vacuum filter or washer is shown in FIG. 1, in combination with a standard rotary drum filter and a steam hood. The rotary vacuum filter 10 is shown comprisng a cylindrical drum 11, mounted in rectangular tank 12, free to rotate about its cylindrical axis 13. The internal lateral surface area of the drum, shown in FIGS. 2 and 3 as a lattice work 15, is of generally open framework construction which provides support for a flexible cloth, felt or wire 16, fitted to smoothly cover the entire drum framework. The tank 12 is dimensioned so that the lower portion of the drum 11 may be submerged in a liquid slurry 17 from which the solid insoluble material is to be removed. A vacuum means, not shown but indicated by arrow 26, such as a barometric leg, operates to evacuate the drum through a rotary valve-attachment at the drum journal axis 13.

FIGS. 1–4 show the suction box improvement 20 which comprises an enclosed chamber 21 fitted adjacent an arcuate peripheral section 22 of the filter drum 11. The outermost surface 23 of the chamber with respect to the drum peripheral surfaces is perforated by a plurality of apertures 30. The suction box 20 is fixedly supported (supporting structure not shown) independently of the rotary drum and spaced at least sufficiently from the filter drum surface so that the drum is free to rotate. A vacuum means (not shown) independent of the drum vacuum means is connected to the suction box chamber at an outlet connection 24 shown located at top end of the suction box 20. Vacuum applied to the chamber thus pulls fluid and/or air into contact with apertured surface 23 and through perforations 30.

The rotary drum 11 and suction box 20 combination is fitted with a flexible porous or foraminous belt 35 of material similar to that normally covering the periphery of a standard vacuum filter. The belt 35 contacts the lateral surface area of the drum not adjacent the suction box and contacts the apertured exterior surface 23 of the suction box 20. The belt 35 is sufficiently tensioned to adhere to the rotary drum surface 16 so that rotation of the drum 11 about its axis 13 causes the belt 35 through friction forces to rotate with the drum 11, sliding over the exterior surface 23 of the suction box 20.

In operation, the tank 12 is partially filled with a slurry of liquid 17 containing a substantially insoluble material that is to be dewatered. The rotating drum 11, with vacuum means 26 acting on the periphery or lateral area of the drum, collects a filter cake or fibrous web 27 upon belt 35, as the submerged portion of the drum 11 passes through the slurry 17. The thickness of the cake 27 depends upon the insoluble material's characteristics as well as the degree of vacuum, cloth porosities and rotational speed of the rotary filter. As the cake leaves the slurry, the vacuum force 26 operating on the drum lateral surface area continues to remove water from the material 27 retained upon the belt 35. Eventually, the filtrate removal rate due to the vacuum force 26 slows and drops essentially to zero as the forces retaining the water in the cake 27 equal the removal forces seeking to extract it. At this point, the belt 35 carries the cake 27 into the influence of the suction box 20 of this invention. The suction force 24 acting on the suction box 20 may be considerably in excess of that operating upon the rotary drum 11 depending upon the desired discharge characteristics of the insoluble material 27.

Referring to FIGS. 2 and 3, a means for discharging the dewatered cake or web 27 from the belt 35 is provided by a discharge chamber 41 which is attached to the trailing (with respect to the counterclockwise rotation of drum 11, indicated by arrow 36) edge of the suction box 20 along its entire length. The discharge chamber 41 is adjacent an arcuate portion 42 of the lateral surface area of drum 11 and has an outermost surface 43, with respect to the drum surface 11, perforated by apertures 38 in substantially the same curved locus as the surface 23 of the suction box 20. An interior wall 37 seals suction chamber 21 from discharge chamber 41. A pressure force such as compressed air, source not shown, connectes to the chamber 41 at connection inlet 39.

In operation, as the cake or web 27 carried upon belt 35 passes from the suction box apertured surface 23 onto the discharge chamber apertured surface 43, compressed air exiting apertures 38 impinge upon belt 35 passing through the belt and blowing the cake or web 27 therefrom. A conveyor belt or other receiving means, not shown, collects the discharge material for transport to the next filter/washer or process.

Referring to FIGS. 1–3, a steam hood 40 is positioned and supported directly over the suction box 20 adjacent apertured surface 23, along its entire length, for supplying superheated steam into contact with the wet material 27 retained on porous belt 35. The hood is supplied with steam through delivery pipe 47 which discharges into a distributor pipe 46 which provides an even distribution of steam throughout hood interior 45. The distributor is standard iron pipe somewhat greater in length than suction box 20, arranged substantially parallel with the axis of drum 11 transverse to the movement of belt 35. The pipe is apertured along its length by perforations 48 through which steam is discharged into the hood interior 45. A hood cover 49 in the shape of an inverted V, supported by distributor 46, ensures delivery of steam to the entire width of the suction box 20 and excludes air from contacting the wet material 27 as it passes over apertured suction box surface 23. The hood terminates nearest the web material 27 with condensate collecting troughs, not shown in detail, for conducting away any condensate that forms on interior cover surfaces. Baffles, not detailed, are located below distributor 46 and fixed to each side of hood cover 49 along its length. The baffles substantially absorb the discharge velocity of the steam as it exits the distributor 46 so that the hood cover 49 is essentially filled with substantially zero velocity superheated steam.

In operation, the hood cover 49 is located sufficiently close to the apertured surface 23 so that little air can leak into the system. As the belt 35 carrying wet material 27 passes over suction box 20, the suction force 24 operating upon apertured surface 23 pulls superheated steam from hood 49 into the wet material 27 wherein a portion of the steam condenses, giving up heat of vaporization causing the liquid portion of the material to increase in temperature and therefore decrease in viscosity, thereby decreasing the tendency of the liquid component to remain in the cake, thus improving the removal of the liquid as it is operated upon by the vacuum force of the suction box.

Referring to FIG. 4, the suction box 20 may be modified to include a carrier roll 60 extending along the length of the suction box 20, the purpose of which is to reduce frictional wear on belt 35 as its slides over stationary suction box apertured surface 23. Carrier roll 60 is supported at each end by bearings and seals, not shown, which may be mounted on the suction box 20. The roll 60 is perforated by apertures 61 along its entire lateral area, such that the vacuum force evacuating suction box 20 also evacuates roll 60, applying a pulling force on the wet material 27 as it is carried across the roll surface 60 supported by belt 35.

The outer surface 23 of the suction box 20 may be depressed inwardly to accommodate mounting of the roll 60 such that the outermost rotating surface of the roll provides partial support for the foraminous belt in a plane that substantially coincides with the apertured surface of the suction box. Similarly, a portion of the apertured surface 23 may be cut away to accommodate the roll 60, as shown in the preferred embodiment of FIG. 4. In operation, the supporting carrier roll 60 rotates at approximately belt speed, greatly reducing sliding friction between the belt and the vacuum box surface.

When the suction box and steam hood are combined with a rotary drum vacuum filter in accord with the teaching of this invention, the insoluble material discharging from the filter/washer may be as high as 30% solids by weight of the product. Most furnishes of kraft brownstock pulp can be expected, for example, to discharge from the filter at above 25% solids by weight, wherein conventional filter/washer drums deliver stock at less than 17% solids.

As an example, laboratory tests were conducted using an Eimco Filter Model 074 manufactured by Eimco of Salt Lake City, Utah, a triangular-shaped suction box adjacent an arc of 67° of the filter drum periphery, 5.5 inches high at its triangular apex, the suction box and filter drum encompassed by a belt comprising a 64×80 mesh polyester fabric manufactured by Huyck Company of Greenville, Tennessee. Bleached kraft at 1½% consistency was used as the slurry material with the filter set at a drum speed of 2 rpm and 7 inches Hg vacuum on the drum. The stock discharging from the drum had a consistency of 12% or 7.3 pounds of water per pound of pulp without the apparatus and combination of this invention. With the suction box and belt installed and 8 inches Hg vacuum on the suction box, the consistency increased to 21% or 3.6 pounds of water per pound of pulp. With a steam hood adjacent the suction box supplying steam to the pulp at the point where the web passed over the suction box apertured surface, consistency increased to 32.2% or 2.1 pounds of water per pound of pulp, with the web discharging at a temperature 204° F.

The example indicates the effectiveness of replacing the air normally pulled into a suction box by the vacuum with steam. The use of steam also reduces foaming caused by pulling air through the web, which reduction means that less defoamer need be added to the stock.

The improved drainage provides greater chemical recovery from the wash water.

The suction box is generally shaped to contour an arcuate portion of the rotary drum. It may, depending upon the desired results, subtend a 30°–90° arc, with a vacuum acting upon the box of up to 20 inches Hg. The suction box must be relatively thin since the object of improving the filter washer/dryer is to be able to make the modification with the very minimum of additional space since most installations are in groups of three or four washer/filters spaced very close together. The shape of the suction box and its location very near the drum surface allows return of the belt to the drum surface without a return, other directional or tensioning roll.

The suction box and steam hood combination may be used independently of a filter drum, as will be apparent to one skilled in dewatering webs on paper machines. For example, the apertured surface of the suction box may be shaped to conform to any arcuate path a wire-supported web may be required to travel. The other dimensions of the suction box may be adjusted, consistent with necessary evacuation capacity, to fit into narrow or obstructed locations. The crescent or triangular-shaped suction box shown in the figures and described in the example is particularly useful adjacent rolls, other than the filter drum previously discussed, where space limitations cause difficulties.

Other modifications of the inventive combination and additional applications will be obvious to those skilled in the art.

What is claimed is:

1. A modified rotary drum vacuum filter, having improved dewatering capability over an existing unmodified filter, of the type wherein a drum is supported horizontally and rotated about its axis, has closed ends, a substantially open lateral surface area supporting a foraminous cloth and a first vacuum means evacuating the interior of the drum, wherein the lower portion of the drum is adapted to be submerged in a slurry of substantially insoluble material which, upon contact with said foraminous cloth, adheres to and is partially dewatered in response to the first vacuum means operating upon the drum, the improvement comprising:

a suction box, substantially crescent-shaped in cross-section, suspended independently of the drum so that the drum is free to rotate without contacting said box, said box having an inner surface, with respect to the drum, that substantially conforms to the curved surface of the drum, and a smoothly contoured outer surface of the suction box, said outer surface terminating in the same plane as the inner surface but having a greater arc length in cross-section than the inner surface in cross-section, said outer surface being apertured;

a second vacuum means operating upon the suction box; and an endless foraminous bet, encompassing only the apertured surface of the suction box and the lateral surface of the drum not adjacent the suction box, wherein rotation of the drum causes said belt to rotate with the drum as a result of friction forces between said belt and drum, sliding over the suction box outer surface, whereby a slurry of a substantially insoluble material in contact with the foraminous belt is partially dewatered by the first vacuum means evacuating the drum, in the area where the belt contacts the drum surface, and by the second vacuum means evacuating the suction box, in the area where the belt contacts the apertured suction box surface.

2. The modified filter of claim 1 wherein said suction box includes a means for reducing sliding friction between said apertured surface of the suction box and said belt, comprising: a carrier roll means for at least partially supporting the foraminous belt as it rotates with the filter drum, during that portion of belt travel when said belt is in contact with said apertured surface, said roll being free to rotate at substantially the same speed as the rotating belt.

3. The modified filter of claim 2, wherein said carrier roll means comprises:

an apertured roll mounted at each end such that the roll is free to rotate substantially transverse to the apertured surface of the suction box, a portion of the apertured surface of the suction box being depressed to accommodate mounting of the roll such that the outermost rotating surface of the roll provides partial support for the foraminous belt in a plane that substantially coincides with the apertured surface of the suction box, wherein the second vacuum means evacuating the suction box also evacuates said roll thereby dewatering insoluble material supported by the foraminous belt as said belt passes over the roll and apertured surface of the suction box.

4. The modified filter of claim 2, wherein said carrier roll means comprises:

an apertured roll mounted at each end such that the roll is free to rotate substantially transverse to the apertured surface of the suction box, a portion of the apertured surface of the suction box being cut away to accommodate mounting of the roll such that the outermost rotating surface of the roll provides partial support for the foraminous belt in a plane that substantially coincides with the apertured surface of the suction box, wherein the second vacuum means evacuating the suction box also evacuates said roll, thereby dewatering insoluble material supported by the foraminous belt as said belt passes over the roll and apertured surface of the suction box.

5. An improved vacuum filter dryer, comprising:

a drum, horizontally mounted to rotate about its longitudinal axis, with a portion of its periphery submerged in a slurry of insoluble material, said drum having closed ends and a foraminous lateral surface area;

a first vacuum means for evacuating the surface area of said drum;

a suction box, crescent-shaped in cross-section, suspended independently of the drum, spaced therefrom so that the drum is free to rotate without contacting the suction box, said box subtending a portion of the drum lateral surface area, said box having an apertured outer surface;

a second vacuum means, for evacuating said suction box apertured surface area;

an endless foraminous belt encompassing the suction box and that portion of the drum lateral surface area not subtended by said box, said belt being sized in length so that it is sufficiently tensioned to rotate with the drum, sliding over the suction box outer surface; and a steam hood suspended over the suction box spaced sufficiently close to said box to provide a flow of steam onto the suction box outer surface, wherein, as the drum rotates through the slurry, action of the first vacuum means causes a partially dewatered cake to be built up on the foraminous belt in contact with the lateral surface area of the drum, not subtended by the suction box, and, subsequently, as the belt travels across the apertured surface of the suction box the combined action of the second vacuum and steam flowing into the cake from the steam hood causes the cake to become further dewatered.

* * * * *